US006682439B2

(12) United States Patent
Brown

(10) Patent No.: US 6,682,439 B2
(45) Date of Patent: Jan. 27, 2004

(54) MULTI-STRING PUTTER FACE WITH SEPARATE AND VARIABLE TENSION CAPABILITIES AND MULTIPLE POSITION SHAFT WITH ADJUSTABLE SHAFT ANGLE CAPABILITIES

(76) Inventor: Dennis E. Brown, 1909 Andrea Ct., Visalia, CA (US) 93292

( * ) Notice: Subject to any disclaimer, the term of this patent is extended or adjusted under 35 U.S.C. 154(b) by 0 days.

(21) Appl. No.: 09/922,171

(22) Filed: Aug. 1, 2001

(65) Prior Publication Data

US 2003/0027659 A1 Feb. 6, 2003

(51) Int. Cl.[7] ..... A63B 69/36

(52) U.S. Cl. ..... 473/329; 473/340; 473/350; 473/314

(58) Field of Search ..... 473/329, 244, 473/245, 246, 247, 248, 340, 334, 335, 347, 350, 332, 330, 305

(56) References Cited

U.S. PATENT DOCUMENTS 5,116,047 A * 5/1992 Phelan et al. ..... 473/307
5,316,304 A 5/1994 Yost ..... 473/330
5,620,381 A 4/1997 Spalding ..... 473/330
5,795,246 A * 8/1998 Hale ..... 473/340
5,816,931 A * 10/1998 Schooler ..... 473/248
5,863,257 A * 1/1999 Busnardo ..... 473/246
5,899,819 A 5/1999 Mount et al. ..... 473/329

* cited by examiner

*Primary Examiner*—Paul T. Sewell
*Assistant Examiner*—Thanh P Duong

(57) ABSTRACT

An improved golf putter head having a striking surface comprised of multiple strings, each string having separate and variable tension capabilities, and a multiple position shaft with adjustable shaft angle capabilities on the back portion of the putter head. The striking surface is comprised of individual, parallel, equidistant adjustable strings across a recessed area between the lined striking face and the front of the putter head to allow for full flexing of the lines without interference from the head structure. The putter head has curved ends with grooves to accommodate and align the strings. The putter head has holes with setscrews at each end of the string groove ends to lock the strings in place once the desired tension has been achieved. These adjustable string tension mechanisms allow the characteristics of the putter face to be changed to create a harder or softer striking surface. The adjustable shaft mounting points on the back portion of the putter head allow the putter to be used as a right handed model, a center alignment model, or a left handed model.

1 Claim, 5 Drawing Sheets

MULTI-STRING PUTTER FACE WITH SEPARATE AND VARIABLE TENSION CAPABILITIES AND MULTIPLE POSITION SHAFT WITH ADJUSTABLE SHAFT ANGLE CAPABILITIES

CROSS-REFERENCE TO RELATED APPLICATIONS

Not applicable.

STATEMENT REGARDING FEDERALLY SPONSORED RESEARCH AND DEVELOPMENT

Not applicable.

BACKGROUND

1. Field of Invention

This invention relates to golf putters, specifically to the striking surface of the putter which is a striking surface of flexible, individual, parallel, equidistant strings, each with separate and variable tension capabilities, and a multiple position shaft with adjustable shaft angle capabilities, thus providing controlled contact and precision placement.

2. Description of Prior Art

Putting is one of the most exacting and exciting parts of a golf game. Significantly, most tournaments are won on the putting green! Because the putting aspect of the game of golf is so important, the design and construction of golf putters have undergone numerous changes over the years: the goal-successful putting.

This invention is created to substantially enhance or improve the user's putting skill. The "multi-string putter face with variable tensions and adjustable shaft is designed to provide greater accuracy in distance and direction. This putter facilitates precision placement with any of the innumerable stances and grips adopted by golfers.

Golf putter technology strives to eliminate inconsistent shotmaking. A plethora of golf putters exhibit a multitude of designs and are constructed from a wide variety of materials.

One design from Pixl Golf incorporates stainless steel inserts composed of 100 individual pixels. The theory: each acts independently at impact, like coils on a mattress, for consistent distance and feel. An example of putter or golf club head designs utilizing inserts or materials to change the resiliency of the face of the head include those disclosed in U.S. Pat. Nos. Des. 1,562,956; 1,939,414; 4,805,922; 5,407,196; and a French Patent to Marcorelles.

Some designs have been made to alter the weight distribution of a putter in an effort to reduce the tendency of a putter to rotate when a golf ball is struck off center. See for example U.S. Pat. Nos. Des. 4,265,451; 3,843,122; 4,253,667; 4,369,974; and 1,537,320.

Other examples of designated putter designs are disclosed in U.S. Pat. No. Des. 57,980 (Kraeuter), U.S. Pat. Des. 63,284 (Challis), 1,454,267 (Challis et al.), U.S. Pat. No. Des. 1,503,291 (Rimmer), U.S. Pat. No. Des. 1,666,174 (Holland).

Other prior art patents provide a putter that includes variously weighted handles. For example: U.S. Pat. Nos. Des. 5,364,102; 4,461,479; 5,465,967; and 5,554,078.

U.S. Pat. No. 5,620,381 (Spalding) shows a putter having a plurality of fine spring wire on the putting face.

In order to improve the chances of properly striking the golf ball, other prior art patents have concentrated on improving the putters head shape, obtaining a better balance for the head, changing the balls striking surface, and placing indicia on the head. See for example, U.S. Pat. Nos. Des. 196,734; 218,178; 234,206; 234,207; 234,208; 234,209; 234,858; 235,567; 236,517; 239,401; 239,402; 4,592,552; 4,163,554; 5,401,022; 5,474,300; and 239,725.

In order to understand the advantages of one type of putter verses another, the putting style of the user must be addressed. Thus, other prior art patents have developed putters which have various novel elemental length relationships and elemental weight relationships. See for example, U.S. Pat. Nos. Des. 5,209,474; 5,632,691; and 5,595,385.

U.S. Pat. Nos. 3,679,207 and 4,227,694 describe putting principles. Additionally, various problems related to putting which golfers have attempted to overcome in their search for the ultimate putter are described in U.S. Pat. No. 4,605,228.

U.S. Patent No. 6,213,890 employs the application of the principles of physics to create a golf putter with increased mass and a compensating mass distribution sufficient to maximize the "sweet spot" on the putter head and claims to substantially minimize extraneous error which could influence a putt stroke after the golfer has committed to it.

The area on the club face which should come into contact with a golf ball to give the greatest and straightest direction to the ball and the best handling feeling is called the "sweet spot". The "sweet spot" is an area about the center of percussion. The center of percussion is defined as a small part of the putter face wherein there is very little or no torque when this part of the club face contacts the golf ball.

The present invention maximizes the "sweet spot"; it provides greater accuracy in direction and distance by enlarging the surface area in contact with the ball; establishes more controlled contact with the "sweet spot"; allows the "sweet spot" to cushion or wrap around the ball for precision placement, initiates a truer roll upon release; helps promote a gentle grip, and prevents the ball from hopping off the putter at impact.

In addition to eliminating inconsistent shot making, golf putter technology strives to minimize deviation from the golfer's intended stroke. This new golf putter addresses both issues and will be of great advantage to golfers. None of the above inventions and patents, either singularly or in combination, disclose a multi-string putter face with individual variable tensions and an adjustable shaft.

SUMMARY

In accordance with this invention, the striking surface of a putter head is comprised of multiple, individual, parallel, equidistant strings, each with separate and variable tensions, and a multiple position shaft with adjustable shaft angle capabilities for controlled contact and precision placement. The flexible strings are designed to provide greater accuracy and direction by maximizing the "sweet spot", enlarging the contact area, initiating an immediate rolling motion to the ball, and improving the feel. Additionally, the adjustable shaft mounting points allow the putter to be used as a tight handed model, a center alignment model, or a left handed model. Furthermore, loosening and tightening setscrews at the bottom of these shaft mounting holes allows for repositioning of the shaft angle in relation to the putters striking surface, thus accommodating any putting style.

OBJECTS AND ADVANTAGES

In addition to the objects and advantages described in this patent, still other objects and advantages include:

Objects:

(a) It is a primary object of this invention to provide an improved golf putter;

(b) Another object of this invention is to provide a golf putter having an improved striking face;

(c) Still another object of this invention is to provide a golf putter with a shaft which can be repositioned along the backside of the putter head; and which can also be adjusted to reposition the shaft angle in relation to the putter striking surface, thereby accommodating many putting styles;

(d) A further object of this invention is to provide an improved golf putter to accommodate the many golfing stances, grips, and swings adopted by individual golfers with different physical characteristics and varying abilities;

(e) Concurrent therewith, another object of the present invention is to provide a golf putter with enhanced feel (f) Still another object of this invention is to provide a golf putter having a striking face which imparts immediate rolling motion to a struck golf ball;

(g) An additional object of this invention is to provide a golf putter having a larger more flexible "sweet spot";

Advantages:

From the description herein, this invention provides an improved golf putter which has all the advantages of the prior art with additional advantages which include:

(a) The striking surface of individual strings creates a slight cupping effect which projects the ball on a true roll as opposed to the ball sliding or scooting or spinning over the putting green;

(b) The individual parallel strings on the face of the putter, each with variable tension refinement capabilities, increases the contact time with the ball, giving the golfer more control of the ball;

(c) When executing the putting stroke, the flexible strings will maximize the "sweet spot" by increasing the center striking area;

(d) The flexible strings cushion the ball to prevent the ball from hopping off the putter at impact;

(e) The striking surface of individual strings with variable tensions provides better feel resulting in smoothness, consistency, and putting confidence;

(f) The adjustable shaft adjusts to the golfers different physical characteristics, varying abilities, and personal preferences;

(g) The multi-string putter face promotes accuracy and control because the striking surface has more surface area in contact with the ball;

(h) The multi-string putter with variable tensions and adjustable shaft also minimizes the tendency to pull or push the ball;

(i) This invention also provides a better feel as the variable tension strings cushion the contact area which helps promote a gentle grip.

These and other objects and advantages of the present invention will become readily apparent upon further review of the following descriptions and drawings.

DRAWING FIGURES

The accompanying drawings which are incorporated in and form a part of the specification, illustrate preferred embodiments of the present invention and together with a description serve to explain the principles of the invention in the drawings.

REFERENCE NUMERALS IN DRAWINGS

Figure 1:
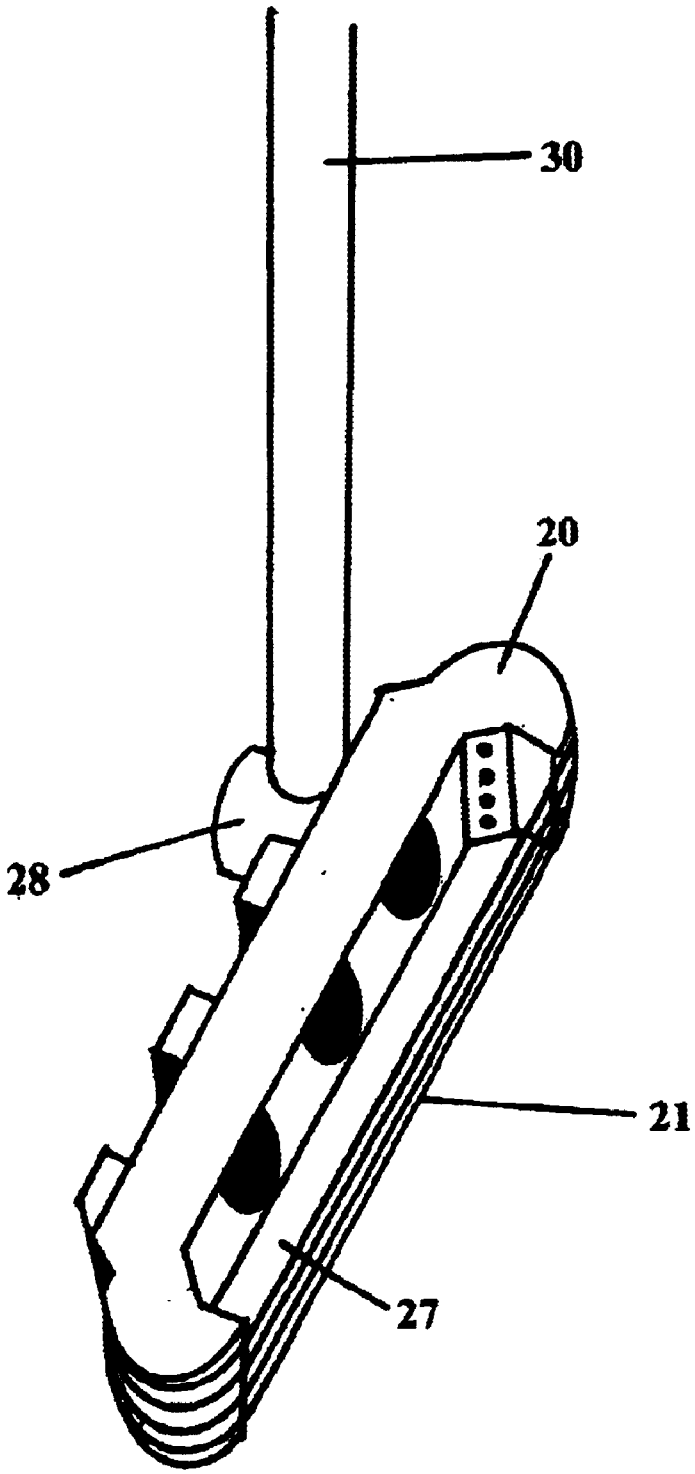
FIG. 1 shows isometric view of the assembled putter.

20 Putter head
21 Nylon line, Musical wire, Titanium string or any other similar material
22 Line placement grooves
23 Setscrew hole for holding string tout
24 Hole in Putter head for inserting shaft assembly
25 Hole through which string is passed to be held tout
26 Setscrew hole in bottom of club head to hold shaft assembly in place
27 Space between strings and club head
28 Dowel piece of club shaft assembly
29 Setscrew to hold string tout
30 Club shaft
31 Shaft grip
32 Metal pine in dowel to glue shaft to dowel assembly
33 5° club face loft
34 Setscrew in bottom of club head to secure club shaft in place and adjust the angle of the shaft
35 Angle that shaft can be positioned
36 Curve portion of head
37 Drilled out area to receive shaft
38 Cast hosel piece

DETAILED DESCRIPTION

As required, detailed embodiments of this improved golf putter are disclosed herein; however, it is to be understood that the disclosed embodiments are merely exemplary of this invention, which may be embodied in various forms. Therefore, specific structural and functional details disclosed herein are not to be interpreted as limiting, but merely as a basis for the claims and as a representative basis for teaching one skilled in the art to variously employ this invention in virtually any appropriately detailed structure.

Referring to FIG. 1 which shows putter head 20 attached by mounting assembly 28 to shaft 30. The striking surface 21 of the putter head 20 is made up of multiple strands of string, monafilament line, nylon line, musical wire, titanium line, and/or other similar materials. The design of putter head 20 and striking face 21 creates cushioning space 27.

Figure 2:
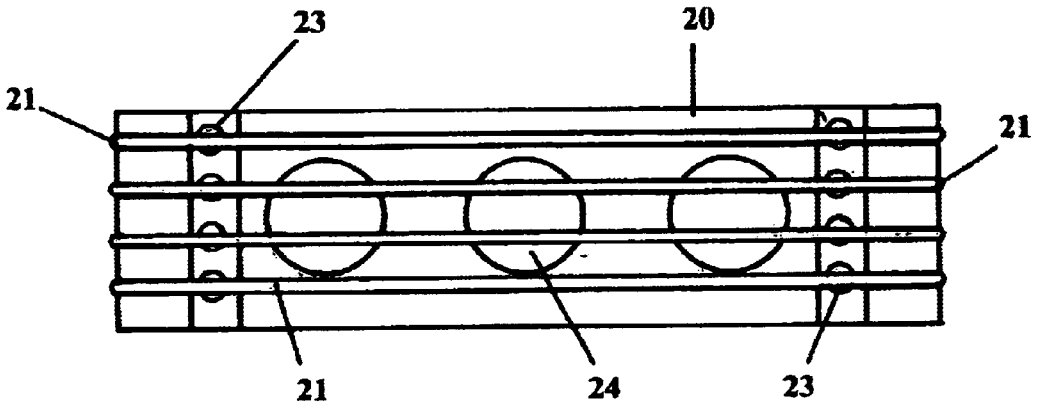
FIG. 2 shows frontal view of the putter head.

Referring to FIG. 2 which shows a front view of putter head 20 with 4 monofiliment lines 21 comprising the striking face. Each monafiliment line 21 is secured by setscrews in holes 23 at each end position. Each monofiliment line 21 is capable of being tensioned individually, thus creating different effects in the loft of the striking face 21. The three shaft positioning holes 24 allow for the different positioning of the putter shaft 30.

Figure 3:
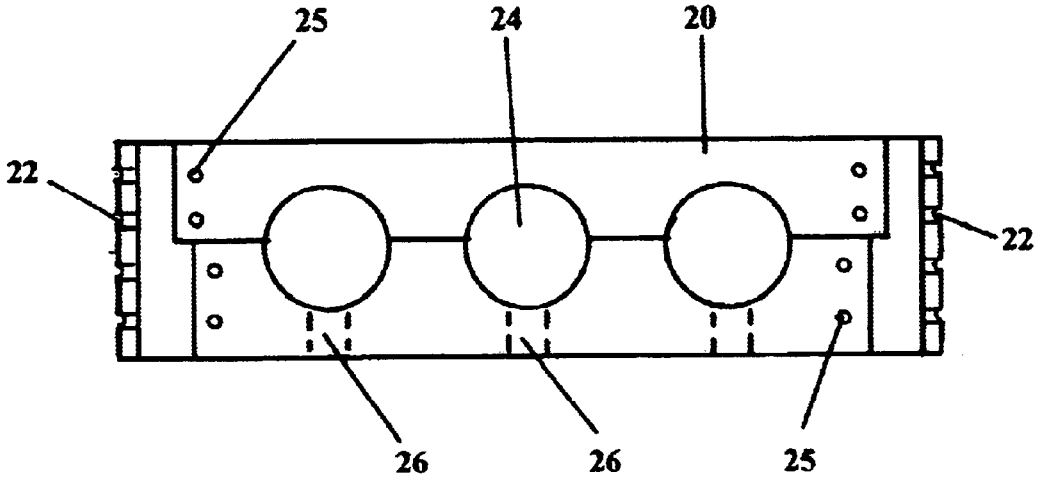
FIG. 3 shows the rear view of the putter head.

Referring to FIG. 3 which shows the rear of putter head 20 comprised of grooves 22 at either end of the putter head 20 to form the structured alignment of monafiliment line to create the desired striking face 21, the holes 25 are where the lines exit the putter head 20. The setscrew holes 26 make the shaft mounting assembly fixed.

Figure 4:
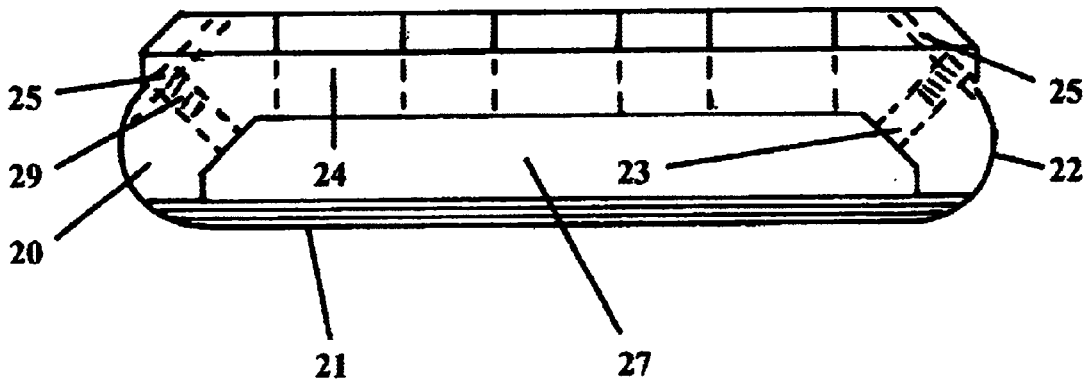
FIG. 4 shows the top view of the putter head.

Referring to FIG. 4 which shows a top view of putter head 20 showing the path of line 21 across the space 27 around the radius 34 and in the grooves 22 through the holes 25 and secured by setscrews 29.

Figure 5:
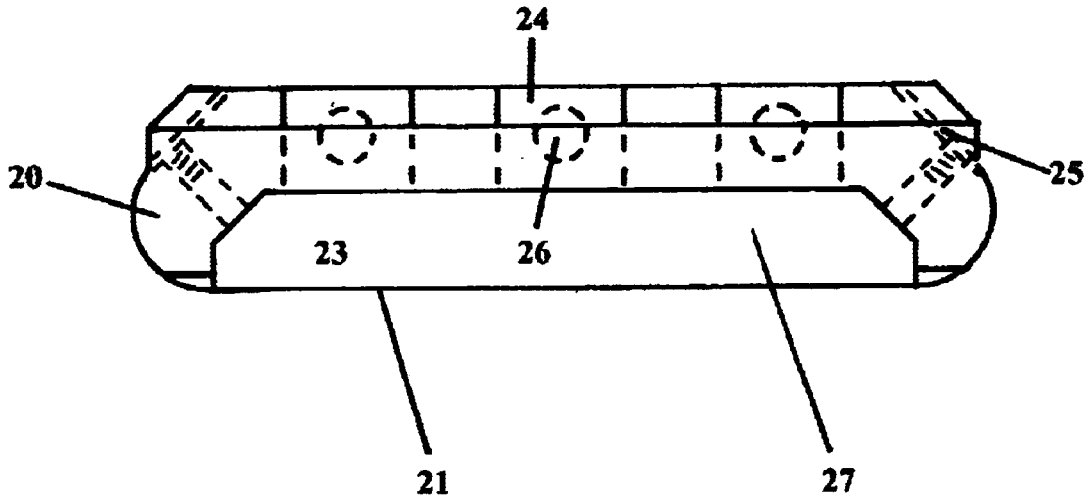
FIG. 5 shows the bottom view of the putter head.

Referring to FIG. 5 which shows the bottom view of putter head 20 with same description as FIG. 4 with bottom view.

Figure 6:
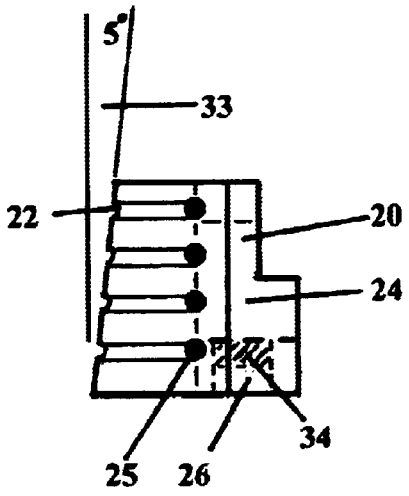
FIG. 6 shows the side view of the putter head.

Referring to FIG. 6 which shows the end view of putter head 20 with alignment grooves 22 and striking holes 25 with corresponding setscrew holes 26 and shaft positioning hole 24. Also shown is a five degree loft 33 in the putter face.

Figure 7:
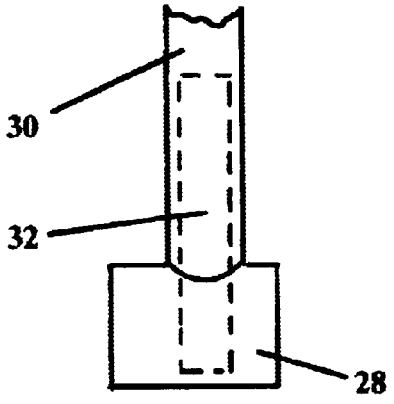
FIG. 7 shows the side view of the shaft mounting assembly.

Referring to FIG. 7 which shows the club shaft assembly is comprised of a brass dowel 28 with a threaded shaft stem insert 32 within the shaft 30.

Figure 8:
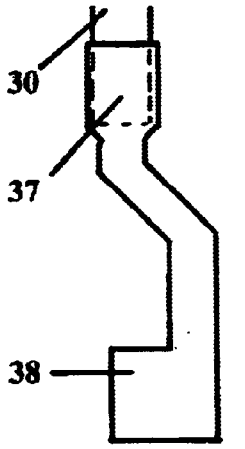
FIG. 8 shows the cast hosel shaft assembly.

Referring to FIG. 8 which shows the club head 20 with a shaft 30 inserted depicting the shaft angles 35 in which the club shaft 30 may be used in this at the center position hole 24.

Figure 9:
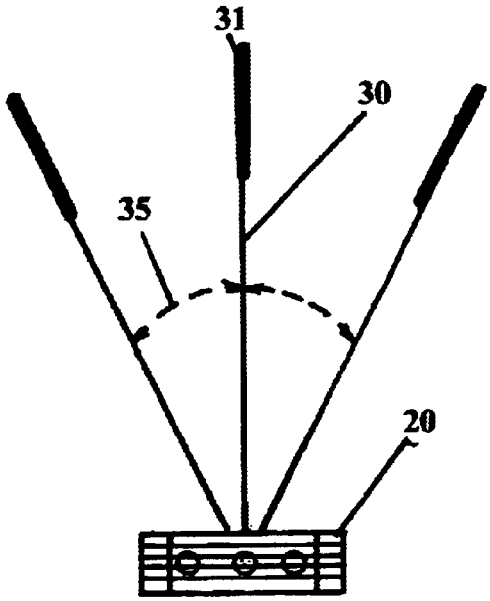
FIG. 9 shows the frontal view of the assembled putter with shaft mounted at the center position.
Figure 10:
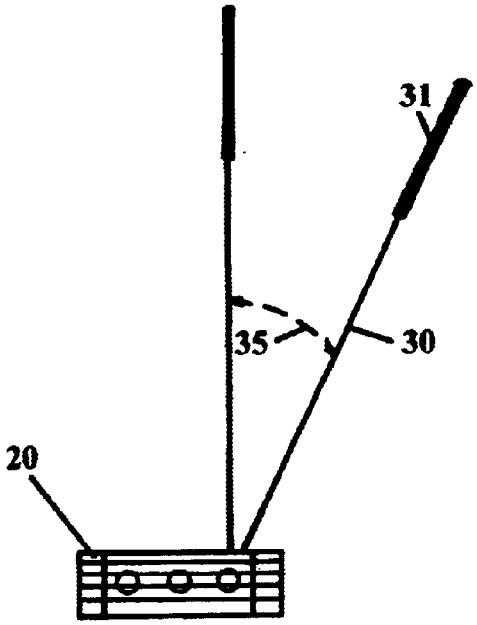
FIG. 10 shows the frontal view of the assembled putter with shaft mounted at the right-hand position.
Figure 11:
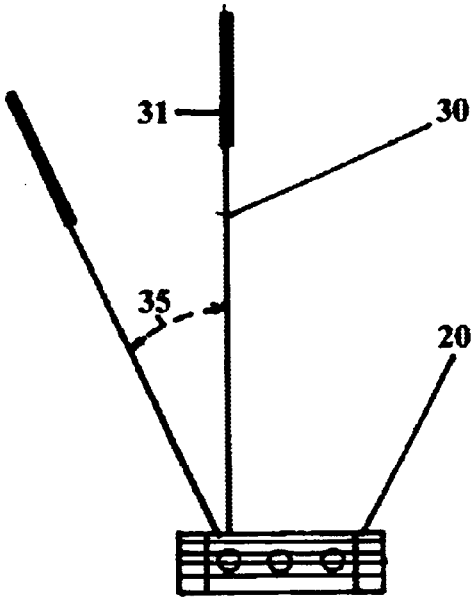
FIG. 11 shows the frontal view of the assembled putter with shaft mounted at the left-hand position.

Referring to FIG. 9 which shows club head 20 with club shaft 30 in positioning hole 24 which is the right hand position depicting the degree of angle 35 with various right hand placement positions. Referring to FIG. 10 same as FIG. 9 only depicting the left hand position.

Operation

A preferred embodiment of this improved golf putter is comprised of a putter head assembly with a striking surface of tensioned parallel string, wire, or line and a multiple position shaft with adjustable shaft angle capabilities. The ends of the putter head assembly are curved and grooved to accommodate multiple parallel lines of resilient materials such as nylon line, musical wire, monofiliment line, high tensile strength strings and any other material which when tensioned can form a flexible striking surface. The striking surface has more surface area in contact with the ball than most other putters, thus giving a high degree of control and accuracy to the ball. Each line is independent from the others making it possible to tension each line with its own tension setting. By adjusting the line tension higher or lower, the characteristics of the putter face can be changed to create a harder or softer striking surface. Also, the lines can be tensioned at different tensions to change the effective behavior of the loft of the putter face. The improved golf putter as set forth above has a recess area between the lined striking face and main putter body to allow for full flexing of the lines without interference from the main body structure. The amount of depression of the lines is determined by the tension of the lines when the ball is struck. The improved golf putter as set forth above has curved ends with grooves to accommodate the lines. The grooves align the lines to keep them at equal and parallel distance from each other. The rounding of the putter head ends guide the lines over the surface to keep them from having indentations which could cause weak spots and increase the possibility of line breakage. The improved golf putter as set forth above has holes in the putter head with setscrews at each of the line groove ends to lock the lines in place once the desired tension has been achieved. The tensioning process is accomplished by placing the putter head in a special jig with a foot pound scale attached; this indicates when the line is at the desired tension and is ready to be locked in place by the setscrews. The improved golf putter as set forth above has three large shaft mounting holes in the putter head running from the recessed area at the face of the club head to the rear of the club head to accommodate a brass dowel shaft attachment assembly. The mounting holes have setscrews located in the bottom of the holes to lock the shaft mounting assembly in place. Any standard manufactured club shaft can be mounted to the club head with the mounting assembly. The three mounting holes allow the putter to be used as a right handed model, a center alignment model, or a left handed model. Loosening and tightening the setscrews at the bottom of the large holes make it possible to reposition the shaft angle to the putting surface which in turn allows the putter to be custom fitted to any putting style.

Conclusion, Ramifications, and Scope

In accordance with the improved putter, the striking surface of a putter head is comprised of multiple individual, parallel, equidistant strings, each with separate and variable tensions, and a multiple position shaft with adjustable angle capabilities. This improved putter is created to substantially enhance or improve a user's putting skill. Consequently, this putter facilitates controlled contact with and placement of the ball. The flexible strings are designed to provide greater accuracy in distance and direction by maximizing the "sweet spot"; by creating a larger contact area with the ball in that the golfer is hitting more of the ball rather than less; and by initiating an immediate rolling motion to the ball. Still further benefits result from the better feel provided by the cushioning effect created by the multi string striking surface. Significantly, an enhanced feel promotes a gentle grip. Additionally, this cushioning effect prevents the ball from hopping off the putter at impact. Moreover, this flexible striking surface increases the contact time with the ball, thereby giving the golfer more control of the ball.

The multiple strings forming the striking surface can be strands of monofilament line, titanium line, musical wire, string or other similar materials.

Furthermore, the shaft mounting assembly on the back of the putter head provides for a right handed model, a center alignment model, or a left handed model. Additionally, the shaft mounting assembly can be adjusted to provide shaft angle variations. Thus this improved golf putter accommodates the many golfing stances, grips, and swings adopted by individual golfers with different physical characteristics, varying abilities, and personal preferences.

Not only is this improved golf putter adjustable and adaptable to individual needs, it also provides a better feel resulting in smoothness, consistency, and putting confidence. Accordingly, the advantages of this invention over the current designs on the market include improved ball control, enhanced feel, increased tendency of the ball to roll rather than slide, greater accuracy resulting from a softer putting face, a maximized "sweet spot", and increased adaptability to golfers individual preferences.

Although the description above contains many specifications, these should not be construed as limiting the scope of the invention, but as merely providing illustrations of some of the presently preferred embodiments of this invention. Thus the scope of this invention should be determined by the appended claims and their legal equivalent rather than the examples give. It is understood that while certain forms of the present invention have been illustrated and described herein, it is not to be limited to the specific forms or arrangements of parts described and shown.

I claim:

1. A golf putter comprising:

a putter head assembly including a main body member having raised curved ends, a front face portion having a recessed area defined by said curved ends of said main body member, a straight back portion having a depression/indentation across approximately the top third forming a ledge which allows shaft angle selection at each of three position connector holes for right-handed, center, or left-handed mounting through said back portion into said recessed area;

a flexible striking surface across said recessed front face portion consisting of four individual wires or strings horizontally spaced and individually secured in said curved ends each having separate tension adjusting means; and an angle adjustment means allowing for selection of shaft angles from back to front at each said hole position location on said back portion.

* * * * *